US011059661B2

(12) United States Patent
Harwath et al.

(10) Patent No.: US 11,059,661 B2
(45) Date of Patent: Jul. 13, 2021

(54) PACKAGING ARRANGEMENT FOR CABLE

(71) Applicant: CommScope Technologies LLC, Hickory, NC (US)

(72) Inventors: Frank Harwath, Naperville, IL (US); James Cunneen, Villa Park, IL (US)

(73) Assignee: CommScope Technologies LLC, Hickory, NC (US)

( * ) Notice: Subject to any disclaimer, the term of this patent is extended or adjusted under 35 U.S.C. 154(b) by 10 days.

(21) Appl. No.: 16/339,879

(22) PCT Filed: Oct. 6, 2017

(86) PCT No.: PCT/US2017/055484
§ 371 (c)(1),
(2) Date: Apr. 5, 2019

(87) PCT Pub. No.: WO2018/071289
PCT Pub. Date: Apr. 19, 2018

(65) Prior Publication Data

US 2020/0047982 A1 Feb. 13, 2020

Related U.S. Application Data

(60) Provisional application No. 62/408,153, filed on Oct. 14, 2016.

(51) Int. Cl.
*B65D 85/04* (2006.01)
*B65D 19/44* (2006.01)
*B65D 85/672* (2006.01)

(52) U.S. Cl.
CPC ..... *B65D 85/04* (2013.01); *B65D 19/44* (2013.01); *B65D 85/672* (2013.01);
(Continued)

(58) Field of Classification Search
CPC ..... B65D 19/00; B65D 19/26; B65D 19/44; B65D 21/02; B65D 85/04; B65D 85/66;
(Continued)

(56) References Cited

U.S. PATENT DOCUMENTS 4,042,107 A * 8/1977 Kendig ..... B65D 19/44 206/597
5,078,269 A * 1/1992 Dekko ..... B65D 85/04 206/397

(Continued)

FOREIGN PATENT DOCUMENTS

| | | |
|---|---|---|
| DE | 102011009316 | 7/2012 |
| EP | 2868610 | 5/2015 |
| KR | 20080098329 | 11/2008 |

OTHER PUBLICATIONS

Extended European Search Report corresponding to European Application No. 17859656.5 dated Mar. 18, 2020.

(Continued)

*Primary Examiner* — Bryon P Gehman
(74) *Attorney, Agent, or Firm* — Myers Bigel, P.A.

(57) ABSTRACT

A package for storing and/or shipping cable includes: a platform having a flat panel having upper and lower surfaces, first locating features on the upper surface, and second locating features on the lower surface; a generally cylindrical hub having a first diameter mounted on the upper surface of the flat panel, the hub engaging and being positioned by the first locating features; and a cable coiled around the hub.

17 Claims, 5 Drawing Sheets

(52) U.S. Cl.
CPC ..... *B65D 2519/00029* (2013.01); *B65D 2519/00064* (2013.01); *B65D 2519/00273* (2013.01); *B65D 2519/00323* (2013.01); *B65D 2519/00815* (2013.01); *B65D 2519/00965* (2013.01)

(58) Field of Classification Search
CPC ..... B65D 85/672; B65D 85/68; B65D 2519/00029; B65D 2519/00064; B65D 2519/00273; B65D 2519/00323; B65D 2519/00815; B65D 2519/00965; B65H 75/14; B65H 75/18; B65H 75/185; B65H 75/40; B65H 75/44; B65H 75/20; B65H 75/26; H05K 5/02
USPC ..... 206/389–409; 242/588.3, 588.6
See application file for complete search history.

(56) References Cited

U.S. PATENT DOCUMENTS 6,145,780 A * 11/2000 Fontana ..... B65H 49/24 242/400
7,549,601 B2 * 6/2009 Horiguchi ..... B65D 19/44 242/174
9,278,827 B2 * 3/2016 Niu ..... B65H 75/14
9,745,167 B2 * 8/2017 Niu ..... B65H 75/14
2004/0050996 A1 3/2004 Russell et al.
2009/0272837 A1 11/2009 Piovesan
2013/0076217 A1 3/2013 Thompson et al.
2014/0056683 A1 2/2014 Niu
2014/0131505 A1 * 5/2014 Gonzalez ..... B65D 85/04 242/588.2

OTHER PUBLICATIONS

International Preliminary Report on Patentability corresponding to International Application No. PCT/US2017/055484 dated Apr. 25, 2019.

International Search Report and Written Opinion corresponding to International Application No. PCT/US2017/055484 dated Jan. 24, 2018.

* cited by examiner

PACKAGING ARRANGEMENT FOR CABLE

RELATED APPLICATIONS

The present application is a 35 U.S.C. § 371 national phase application of and claims priority to PCT Application PCT/US2017/055484 filed Oct. 6, 2017, which claims priority from and the benefit of U.S. Provisional Patent Application No. 62/408,153, filed Oct. 14, 2016, the disclosure of each of which is hereby incorporated herein by reference in its entirety.

FIELD OF THE INVENTION

The present invention relates generally to packaging, and more particularly to packaging of cables for shipment.

BACKGROUND

Global competition is driving down the market prices for "fiber-to-the-antenna" (FTTA) cable assemblies. Packaging now comprises a significant portion of the total product cost. FTTA cable is typically supplied on a reel, with a considerable length of cable (e.g., 200-400 feet) being wound over the reel.

Referring to FIGS. 1-3, typically, a reel 10 employs a spiral wound paper hub 12 that is attached to two reel flanges 14. The flanges 14 are conventionally plywood or built up from multiple planks. The reel 10 is held together by several long threaded rods with washers on either end to spread the load, secured by nuts 16. Significant labor is needed to place each component and torque the nuts properly. A cable 18 is wound onto the reel 10, which is then placed on a wooden cradle 20 made from dimensional lumber and held together with nails. It is secured to the cradle 20 with steel straps 22, and then the entire package is shrink-wrapped.

Since the reel flanges 14 do not protect the top of the reel, it is not possible to stack these reels. This results in high shipping costs because of the low packing density in trailers and shipping containers.

SUMMARY

As a first aspect, embodiments of the invention are directed to a package for storing and/or shipping cable. The package comprises: a platform having a flat panel having upper and lower surfaces, first locating features on the upper surface, and second locating features on the lower surface; a generally cylindrical hub having a first diameter mounted on the upper surface of the flat panel, the hub engaging and being positioned by the first locating features; and a cable coiled around the hub.

As a second aspect, embodiments of the invention are directed to a package for storing and/or shipping cable, comprising: first and second platforms, each platform having a flat panel having upper and lower surfaces, first locating features on the upper surface, and second locating features on the lower surface; first and second generally cylindrical hubs, each hub having a first diameter; a first cable coiled around the first hub; and a second cable coiled around the second hub. The first hub is mounted on the upper surface of the flat panel of the first platform, the first hub engaging and being positioned by the first locating features of the first platform. The second platform is mounted on an upper end of the first hub, the second locating features of the second platform engaging and positioning the second platform. The second hub is mounted on the upper surface of the flat panel of the second platform, the second hub engaging and being positioned by the first locating features of the second platform.

DETAILED DESCRIPTION

Figure 1:
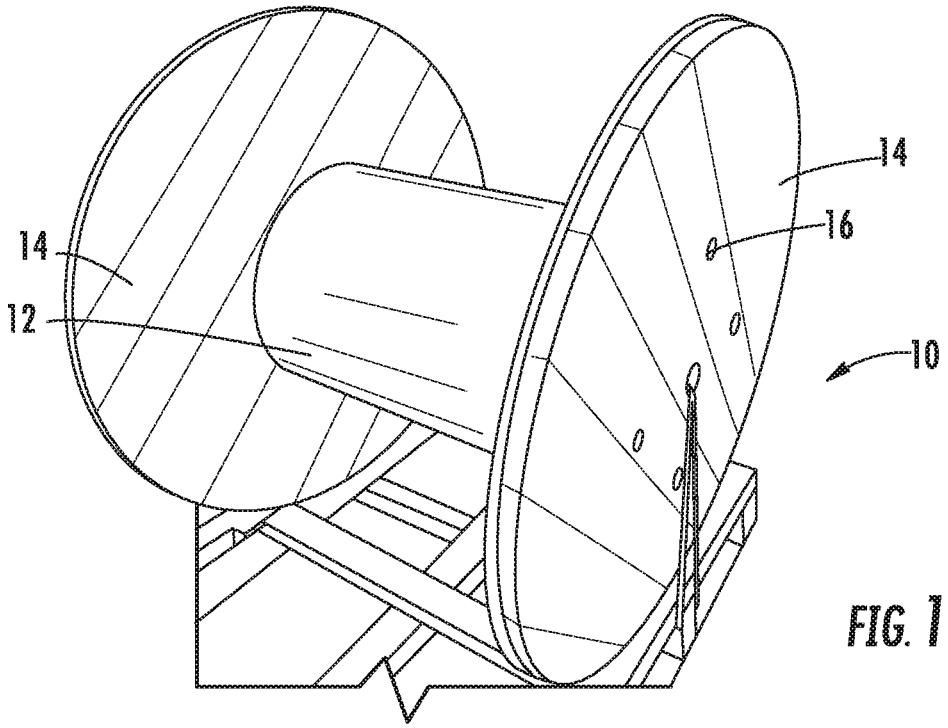
FIG. 1 is a perspective view of a prior art reel used to store and ship cable.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Figure 4:
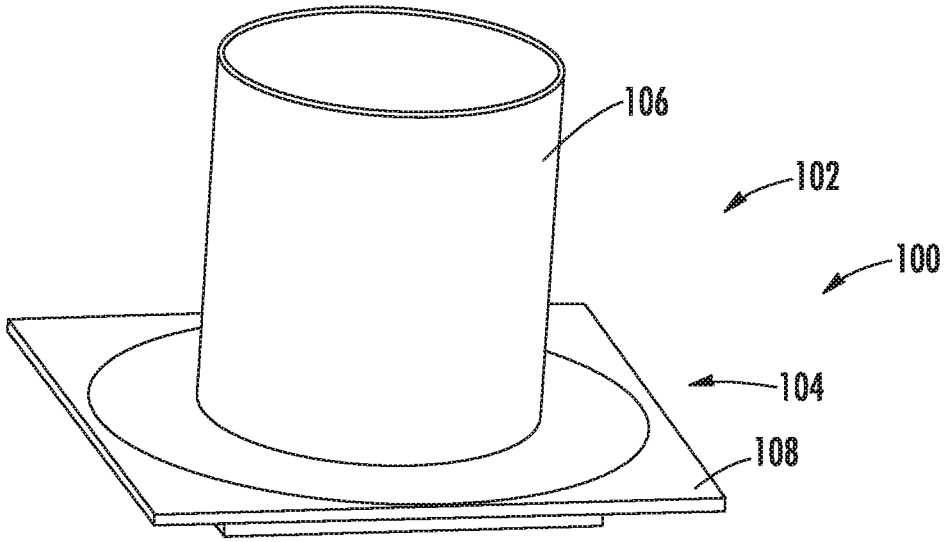
FIG. 4 is a perspective view of a reel for storing and shipping cable according to embodiments of the invention.
Figure 5:
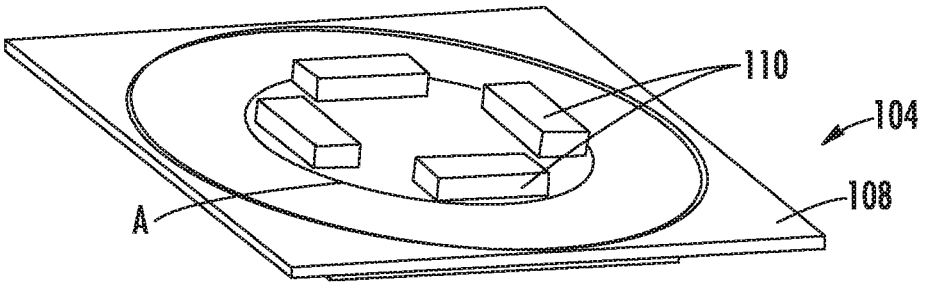
FIG. 5 is a top perspective view of a platform of the reel of FIG. 4.
Figure 6:
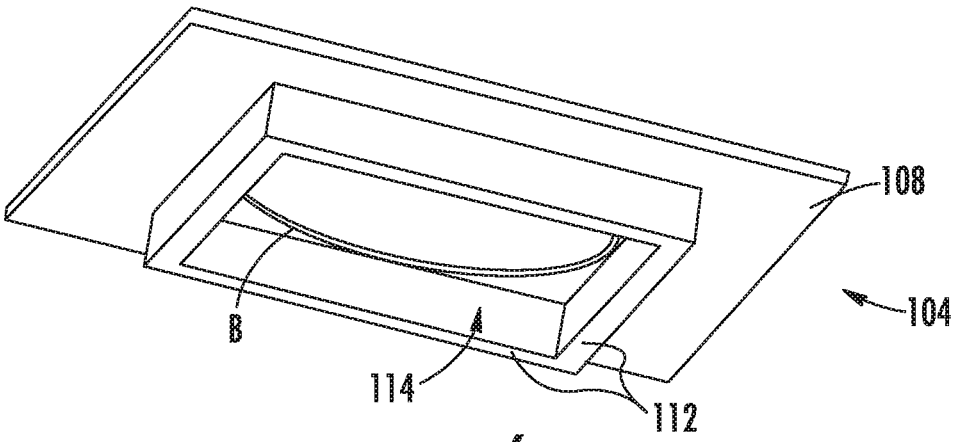
FIG. 6 is a bottom perspective view of the platform of FIG. 5.

Referring now to the figures, FIGS. 4-9 illustrates a package for cable, designated broadly at 100. The package 100 includes a reel 102 that includes a platform 104 and a cylindrical hub 106. As can be seen in FIG. 4, the platform 104 comprises a flat panel 108. Four guides 110 are fixed to the upper surface of the flat panel 108 in an arrangement that generally defines a circle A as shown in FIG. 5. Four members 112 are fixed to the underside of the flat panel 108 to form a generally square pocket 114 (see FIG. 6). Notably, a circle B that inscribes the four members 112 and the circle A that circumscribes the guides 110 are generally of the same diameter.

The platform 104 may be formed of any number of materials. In some embodiments, the flat panel 108 comprises wood, oriented strand board or plywood. The guides 110 and the members 112 may be formed of wood, and may be fixed to the flat panel 108 with nails or similar fasteners. In other embodiments, the platform 104 may be formed via compression molding (for example, the platform 104 may be formed of sawdust with a polymer binder). There may be more or fewer guides 110 and/or members 112 in other embodiments, and/or other locating features (such as projections, protrusions, fingers, grooves, recesses or the like) may be employed instead.

In some embodiments, the flat panel 108 is generally square and has dimensions between about 35 and 50 inches (e.g., 42 inches). The members 112 are typically between about 3 to 5 inches in height and form a generally square pocket 114 of between about 20 to 30 inches per side (e.g., about 24 inches).

Figure 7:
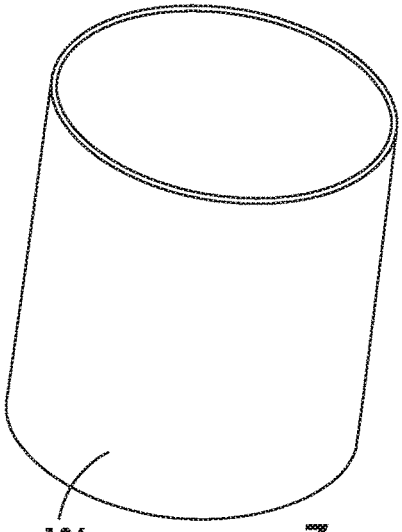
FIG. 7 is a top perspective view of a hub of the reel of FIG. 4.
Figure 8:
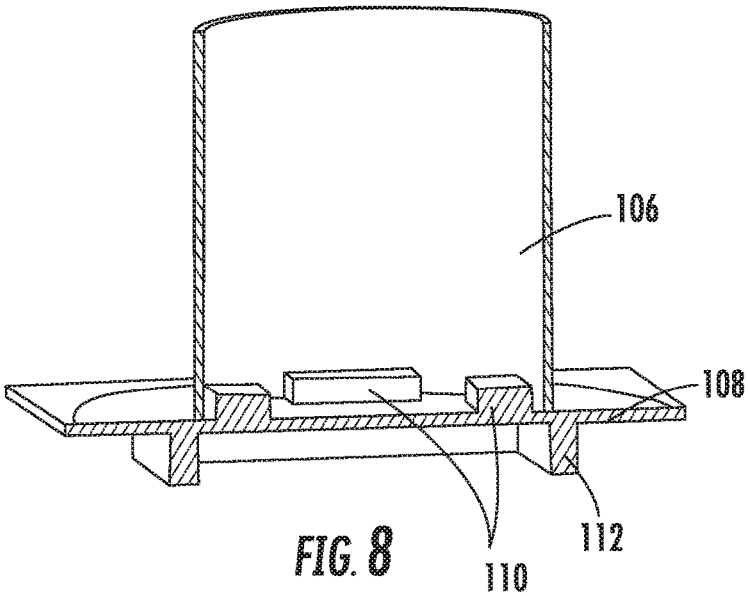
FIG. 8 is a section view of the reel of FIG. 4.

Referring now to FIG. 7, the hub 106 defines a hollow cylinder. As can be seen in FIGS. 4 and 8, the hub 106 rests on the upper surface of the flat panel 108, with the guides 110 maintaining the hub 106 in a position defined by the circle A. As such, the hub 106 typically has an inner diameter similar to that of the circle A. The interaction of the guides 110 with the hub 106 can locate the hub 106 in position on the platform 104 and can enable the hub 106 to be maintained in position on the platform 104 without any fasteners.

The hub 106 may be formed of a variety of materials. In some embodiments, the hub 106 is formed of spiral wound paper. The hub 106 may be of any suitable size; in some embodiments, the hub 106 may have a height of between about 20 and 30 inches (e.g., 26 inches) a diameter of between about 20 and 30 inches (e.g., 24 inches), and/or a thickness of between about ¼ and ½ inch.

Figure 9:
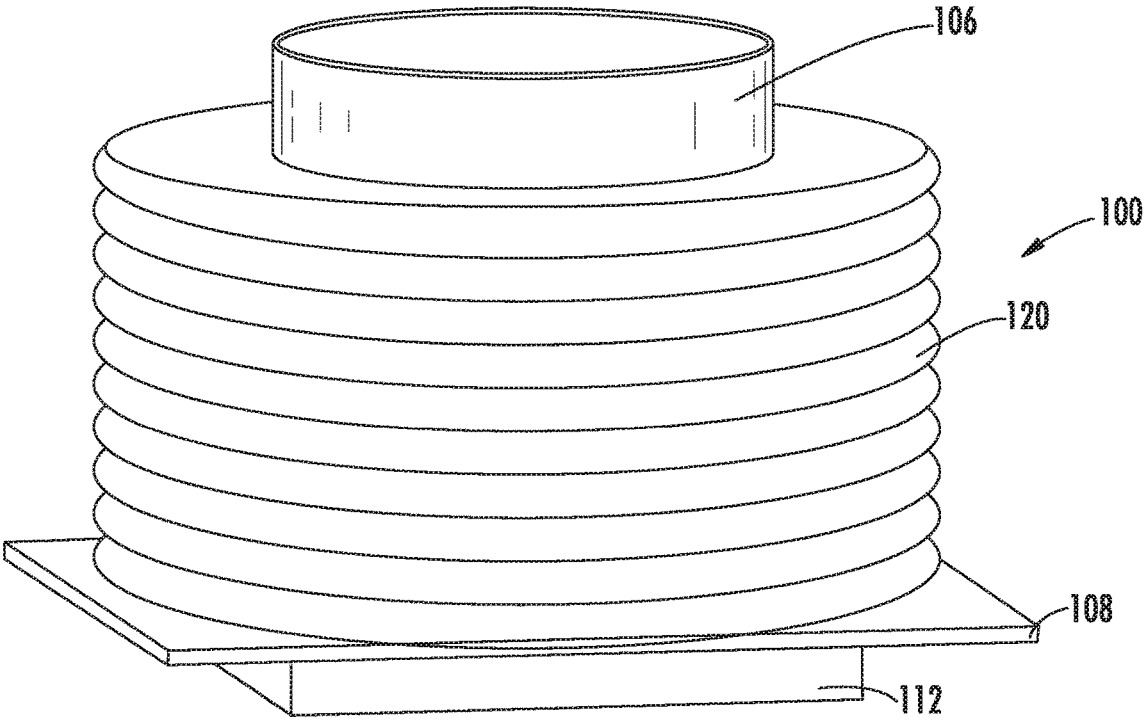
FIG. 9 is a perspective view of the reel of FIG. 4 wound with a length of cable.

Once the hub 106 has been positioned on the platform 104, a cable 120 may be wound onto the reel 102 (FIG. 9). The reel 102 and cable 120 can then be shrink-wrapped or otherwise covered with wrapping in preparation for shipping and storage as the package 100. It should be noted that the members 112 typically are positioned and have sufficient height (as noted above, between about 3 and 5 inches) that the tines of a forklift can fit under the platform 104 and be used to easily lift and transport the package 100.

Figure 10:
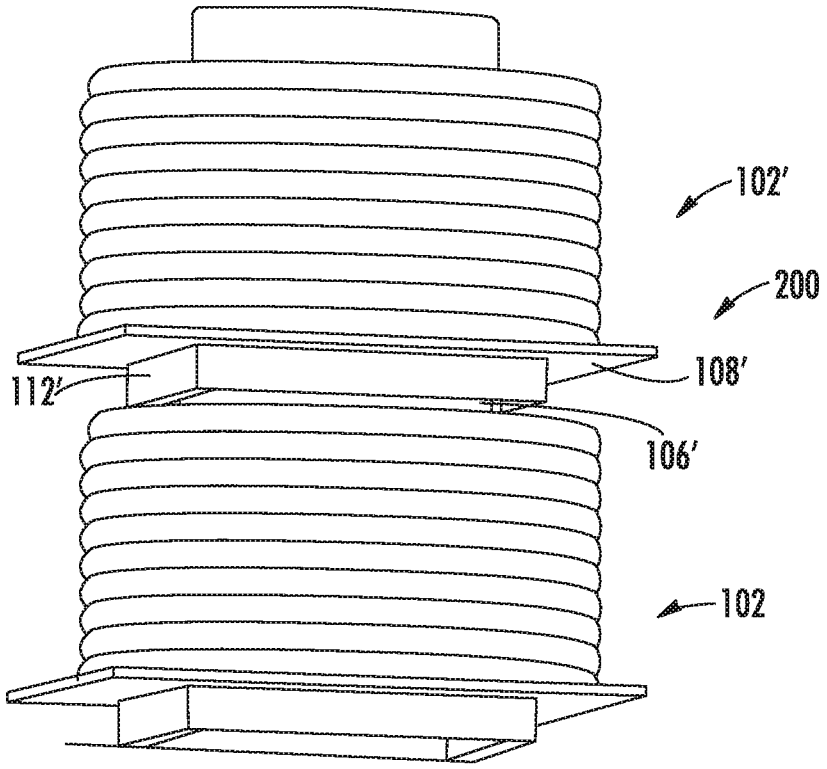
FIG. 10 is a perspective view of two cable-wound reels of FIG. 9 in a stacked configuration.

Referring now to FIG. 10, the reel 102 and cable 120 can be stacked to form a package 200 according to alternative embodiments of the invention. As shown in FIG. 10, reels 102, 102' can be constructed and wound with cable as described above. The reel 102' can then be placed atop the reel 102. More specifically, the upper edge of the hub 106 of the lower reel 102 fits within the pocket formed by the members 112' depending from the lower surface of the flat panel 108' of the upper reel 102'. The engagement of the outer diameter of the hub 106 by the members 112' locates the upper reel 102' relative to the lower reel 102 and provides stability to the stack. Once the reels 102, 102' are stacked as shown, the arrangement can be shrink-wrapped or otherwise covered as described above to form the package 200.

Figure 11:
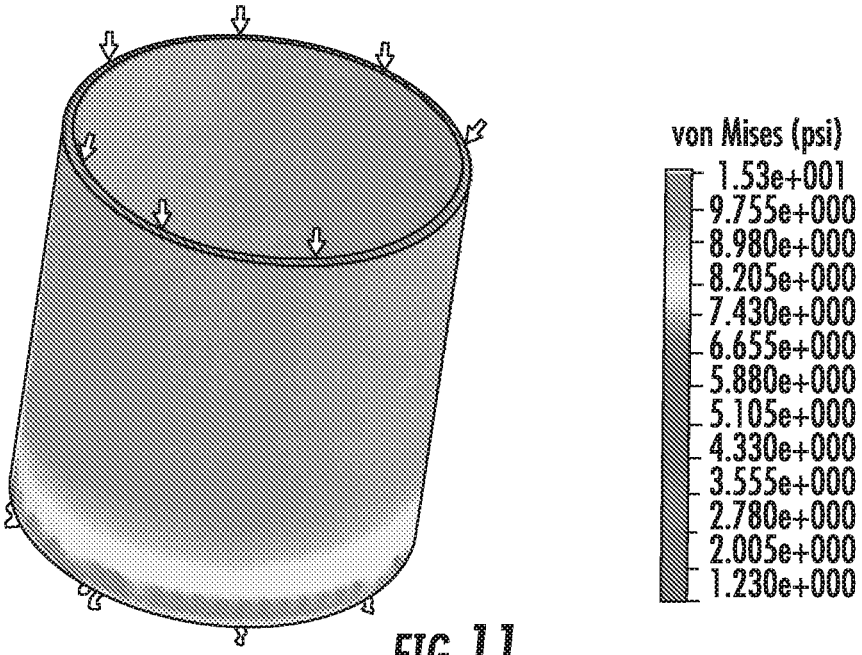
FIG. 11 is a three-dimensional representation of stress experienced by the hub of FIG. 7 under load.

FIG. 11 is a three-dimensional plot of stress experienced by the hub 106 of the lower reel 102 under the load expected from the upper reel 102'. Results indicate that a hub 106 formed of spiral wound paper of ⅜ inch thickness having a height of 26 inches and a diameter of 24 inches should not collapse or buckle under the weight of the upper reel 102'.

Figure 2:
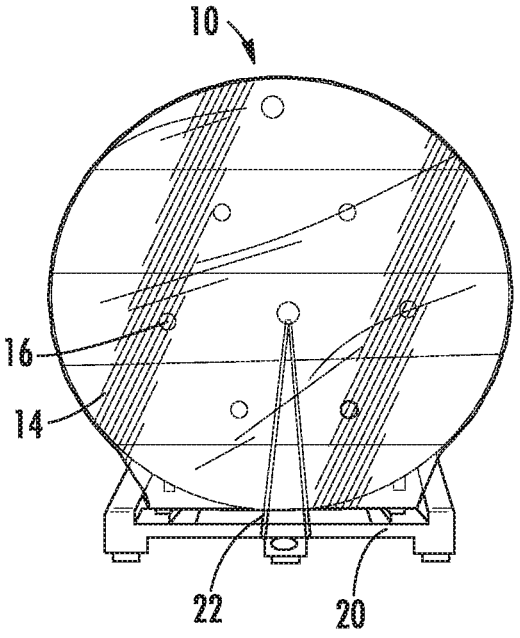
FIG. 2 is an end view of the reel of FIG. 1 mounted on a cradle and covered with shrink-wrap.
Figure 3:
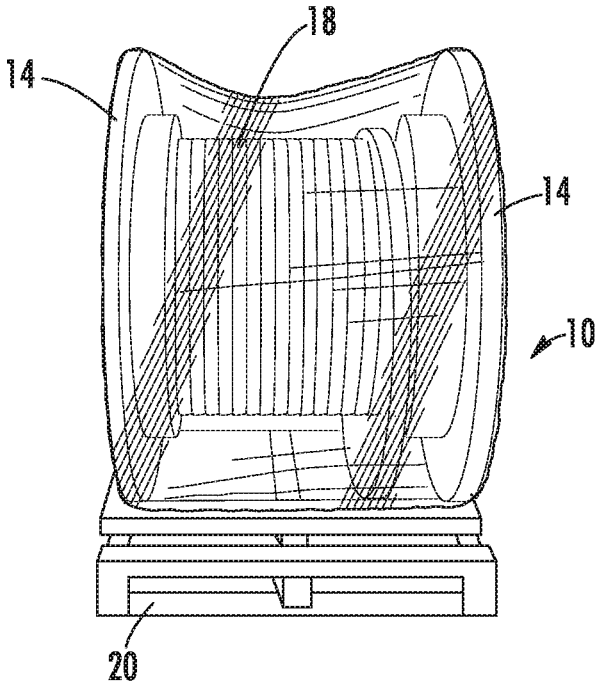
FIG. 3 is a front view of the wrapped reel and cradle of FIG. 1.

Because the reels 102 can be formed into a stack (in some embodiments, three or more reels 102 may be stacked), the reels 102 can be packed more densely than the prior reels 10 of FIGS. 1-3 that cannot be safely stacked.

To uncoil the cable on a conventional reel, the reel 10 is typically suspended horizontally with a pipe through center holes in the flanges 14. This arrangement allows the installer to rotate the reel in a stationary location, paying off the cable 18 (see FIGS. 2 and 3). In contrast, the cable wound onto the reels 102 according to embodiments of the invention can be uncoiled via a turntable or other rotary device. More specifically, a turntable may be placed on the ground under the lower reel 102, allowing the reels 102, 102' to spin in place about a vertical axis, paying off the cable in a similar manner to current reels.

Figure 12:
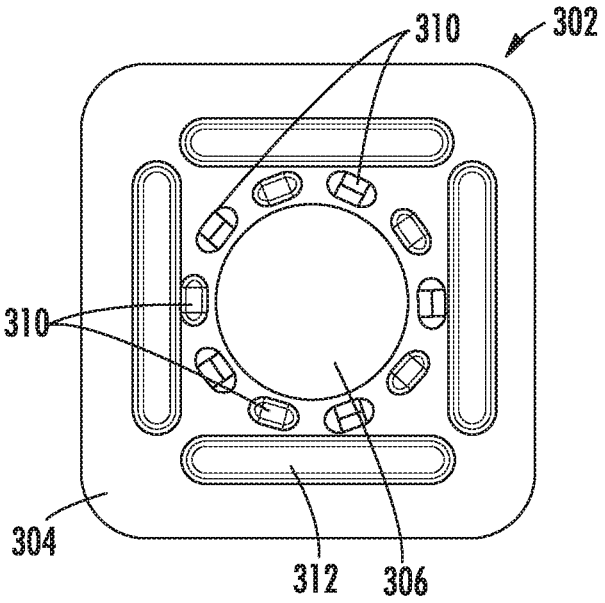
FIG. 12 is a top view of a platform for a reel according to alternative embodiments of the invention.
Figure 13:
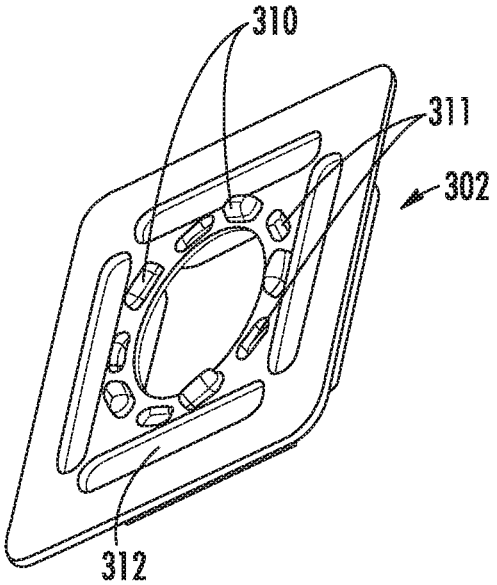
FIG. 13 is a top perspective view of the platform of FIG. 12.
Figure 14:
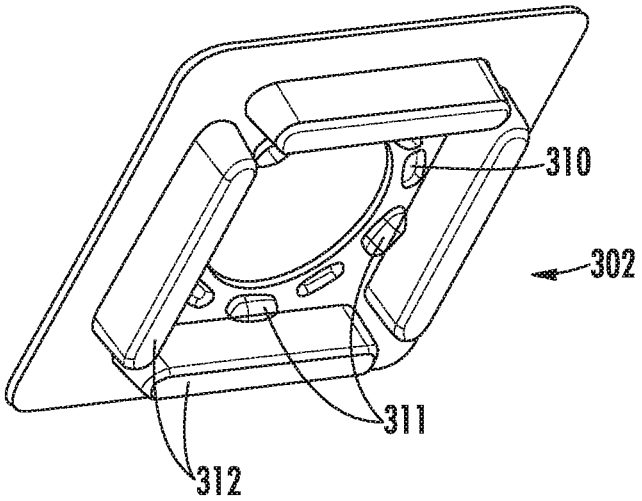
FIG. 14 is a bottom perspective view of the platform of FIG. 12.

Referring now to FIGS. 12-14, another platform according to embodiments of the invention, designated broadly at 302, is shown therein. The platform 302 is a unitary component having a flat panel 304, five guides 310, five projections 311, and four walls 312. The guides 310, which are hollow and extend upwardly from the upper surface of the flat panel 304, define a circle sized to receive a hub similar to the hub 106 described above. The projections 311, which are hollow and extend downwardly from the lower surface of the flat panel 304, define a circle similar in size to the circle defined by the guides 310. The walls 312, which are also hollow and extend downwardly from the lower surface of the flat panel 304, define generally a square sized to receive a hub. The platform 302 can be used in the same manner as the platform 102 described above, with a hub fitting over the guides 310 and receiving a wound coil of cable. Also, multiple platforms 302 can be stacked on each other, with the hub of a lower platform 302 being received between the projections 311 (which are positioned inside the hub) and the walls 312 of an upper platform (which are positioned outside the hub).

The platform 302 may be suitable for compression molding, particularly with the hollowed configurations of the guides 310 and projections 312. Also, there may be more or fewer guides 310, projections 311 and/or members 312 in other embodiments, and/or locating features of other configurations may be used.

The packages 100, 200 and the platform 302 can reduce cost significantly compared to current cable reels. At the same time, they can reduce assembly labor, produce minimal waste, employ materials which require no harmful chemicals, and reduce shipping costs.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

That which is claimed is:

1. A package for at least one of storing and shipping cable, comprising:

a platform having a flat panel having an upper surface and a lower surface, first locating features on the upper surface, and second locating features on the lower surface;

a generally cylindrical hub having an inner diameter and an outer diameter, the hub mounted on the upper surface of the flat panel, the hub engaging and being positioned by the first locating features, wherein the first locating features are positioned such that a circle circumscribing the first locating features has a diameter similar to the hub inner diameter, and wherein the second locating features are positioned such that a circle inscribing the second locating features has a diameter similar to the hub outer diameter; and a cable coiled around the hub.

2. The package defined in claim 1, wherein the first locating features engage an inner surface of the hub.

3. The package defined in claim 1, further comprising wrapping that covers the cable and the hub.

4. The package defined in claim 3, wherein the wrapping is shrink-wrap.

5. The package defined in claim 1, wherein the second locating features extend away from the lower surface a sufficient distance to enable tines of a forklift to be inserted between the lower surface and a surface upon which the platform rests.

6. The package defined in claim 1, wherein the first locating features comprise a plurality of projections positioned to engage an inner surface of the hub, and wherein the second locating features comprise a plurality of walls positioned outside the hub outer diameter.

7. The package defined in claim 1, in combination with a turntable having a vertical axis, the package being oriented such that a central axis of the hub is collinear with the vertical axis.

8. The package defined in claim 1, wherein the platform is compression-molded.

9. The package defined in claim 1, wherein the platform comprises wood.

10. A package for at least one of storing and shipping cable, comprising:

a first platform and a second platform, each platform having a flat panel having an upper surface and a lower surface, first locating features on the upper surface, and second locating features on the lower surface;

a first generally cylindrical hub and a second generally cylindrical hub, each hub having an inner diameter and an outer diameter;

wherein the first hub is mounted on the upper surface of the flat panel of the first platform, the first hub engaging and being positioned by the first locating features of the first platform, wherein the first locating features are positioned such that a circle circumscribing the first locating features has a diameter similar to the hub inner diameter, and wherein the second locating features are positioned such that a circle inscribing the second locating features has a diameter similar to the hub outer diameter; and wherein the second platform is mounted on an upper end of the first hub, the second locating features of the second platform engaging an outer surface of the first hub; and wherein the second hub is mounted on the upper surface of the flat panel of the second platform, the second hub engaging and being positioned by the first locating features of the second platform;

a first cable coiled around the first hub; and a second cable coiled around the second hub.

11. The package defined in claim 10, further comprising wrapping that covers the first and second cables.

12. The package defined in claim 11, wherein the wrapping is shrink-wrap.

13. The package defined any in claim 10, wherein the second locating features of the first platform extend away from the lower surface a sufficient distance to enable tines of a forklift to be inserted between the lower surface and a surface upon which the first platform rests.

14. The package defined in claim 10, wherein the first locating features of the first and second platforms comprise a plurality of projections positioned to engage an inner surface of the respective first and second hubs, and wherein the second locating features comprise a plurality of walls.

15. The package defined in claim 10, in combination with a turntable having a vertical axis, the package being oriented such that a central axis of the first hub is collinear with the vertical axis.

16. The package defined in claim 10, wherein the first and second platforms comprise wood.

17. The package defined in claim 10, wherein the second locating features of the second platform are located radially outwardly of the first hub, and the first locating features of the second platform are located radially inwardly of the second hub.

* * * * *